US011719235B2

(12) United States Patent
Stickel et al.

(10) Patent No.: US 11,719,235 B2
(45) Date of Patent: Aug. 8, 2023

(54) HYDRAULIC DEVICE FOR A RAIL VEHICLE

(71) Applicant: KNORR-BREMSE Systeme für Schienenfahrzeuge GmbH, Munich (DE)

(72) Inventors: Torsten Stickel, Gauting (DE); Marcus Clev, Munich (DE); Benjamin Hirth, Olching (DE); Fabian Elwischger, Neufahrn bei Freising (DE); Nico Kullen, Gilching (DE)

(73) Assignee: KNORR-BREMSE Systeme für Schienenfahrzeuge GmbH

( * ) Notice: Subject to any disclaimer, the term of this patent is extended or adjusted under 35 U.S.C. 154(b) by 523 days.

(21) Appl. No.: 16/789,347

(22) Filed: Feb. 12, 2020

(65) Prior Publication Data

US 2020/0256355 A1 Aug. 13, 2020

(30) Foreign Application Priority Data

Feb. 12, 2019 (DE) ..... 10 2019 103 448.5

(51) Int. Cl.

| | |
|---|---|
| ***F04B 53/06*** | (2006.01) |
| ***F04B 23/02*** | (2006.01) |
| ***B67D 7/08*** | (2010.01) |
| ***B65D 51/16*** | (2006.01) |
| ***B67D 7/78*** | (2010.01) |

(52) U.S. Cl.

CPC ..... *F04B 53/06* (2013.01); *B65D 51/1644* (2013.01); *B67D 7/08* (2013.01); *B67D 7/78* (2013.01); *F04B 23/02* (2013.01)

(58) Field of Classification Search

CPC ..... F04B 53/06; F04B 23/02; F04B 53/16; F15B 1/26; B67D 7/78; B67D 7/08; B65D 51/1644

See application file for complete search history.

(56) References Cited

U.S. PATENT DOCUMENTS

| | | | | |
|---|---|---|---|---|
| 3,981,325 | A * | 9/1976 | Robinson | F16K 27/07 137/587 |
| 4,109,677 | A * | 8/1978 | Burnside | B67D 7/3227 137/586 |
| 2008/0304988 | A1* | 12/2008 | Asaka | B60S 1/481 417/500 |
| 2010/0119393 | A1 | 5/2010 | Osswald et al. | |

FOREIGN PATENT DOCUMENTS

| | | | |
|---|---|---|---|
| CH | 596697 | A5 | 3/1978 |
| CN | 103423243 | A | 12/2013 |
| CN | 104632319 | A | 5/2015 |
| DE | 1838125 | U | 9/1961 |
| DE | 4320692 | A1 | 1/1995 |
| DE | 102005022992 | A1 | 4/2007 |
| DE | 102007047202 | A1 | 5/2008 |
| DE | 102013006611 | A1 | 10/2014 |
| DE | 102016225923 | A1 | 6/2018 |

* cited by examiner

*Primary Examiner* — Atif H Chaudry

(74) *Attorney, Agent, or Firm* — Barnes & Thornburg LLP

(57) ABSTRACT

A hydraulic device for a rail vehicle includes a fluid container, a motor with a pump, a control plate, a control region, a ventilation and purging unit for ventilating and purging the fluid container, wherein the ventilation and purging unit has a valve unit integrated into a wall of a housing of the fluid container, and a channel labyrinth connected to the valve unit.

8 Claims, 5 Drawing Sheets

HYDRAULIC DEVICE FOR A RAIL VEHICLE

CROSS REFERENCE AND PRIORITY CLAIM

This patent application claims priority to German Patent Application No. 10 2019 103 448.5, the disclosure of which being incorporated herein by reference in their entireties.

FIELD

The present invention concerns a hydraulic device for a rail vehicle.

BACKGROUND

Generic hydraulic devices serve to control or regulate a hydraulic flow for various components of a rail vehicle. Such hydraulic devices substantially consist of a fluid container or tank for storing a hydraulic fluid, a motor with a pump for conveying the hydraulic fluid from the fluid container to the control plate, a control plate, and a control region. The hydraulic device may further include a ventilation and purging unit for ventilating and purging the fluid container.

The control plate itself receives the hydraulic connections and the necessary components. The control region and the fluid container are usually arranged on mutually opposing sides of the control plate.

The air pressure in the fluid container must fluctuate within a permitted pressure range on supply or extraction of the fluid, in particular a hydraulic oil, during operation of the hydraulic system. The fluid must not reach the outside from the fluid container.

To prevent negative influences on the quality of the fluid, it is also important that air is drawn in from the environment as rarely as possible.

In hydraulic devices known from the prior art, the ventilation and purging unit is usually arranged at the highest point of the fluid container.

It is also known to integrate a ventilation and purging unit in the control plate.

SUMMARY

Disclosed embodiments provide a hydraulic device which is compact in construction and guarantees reliable ventilation and purging.

Disclosed embodiments provide a hydraulic device for a rail vehicle that includes a fluid container, a motor with a pump, a control plate, a control region, and a ventilation and purging unit for ventilating and purging the fluid container.

In accordance with disclosed embodiments, the ventilation and purging unit may have a valve unit integrated into a wall of a housing of the fluid container, and a channel labyrinth arranged in the fluid container and connected to the valve unit.

BRIEF DESCRIPTION OF FIGURES

Disclosed embodiments are explained in more detail below with reference to the attached drawings, wherein.

DETAILED DESCRIPTION

Figure 1:
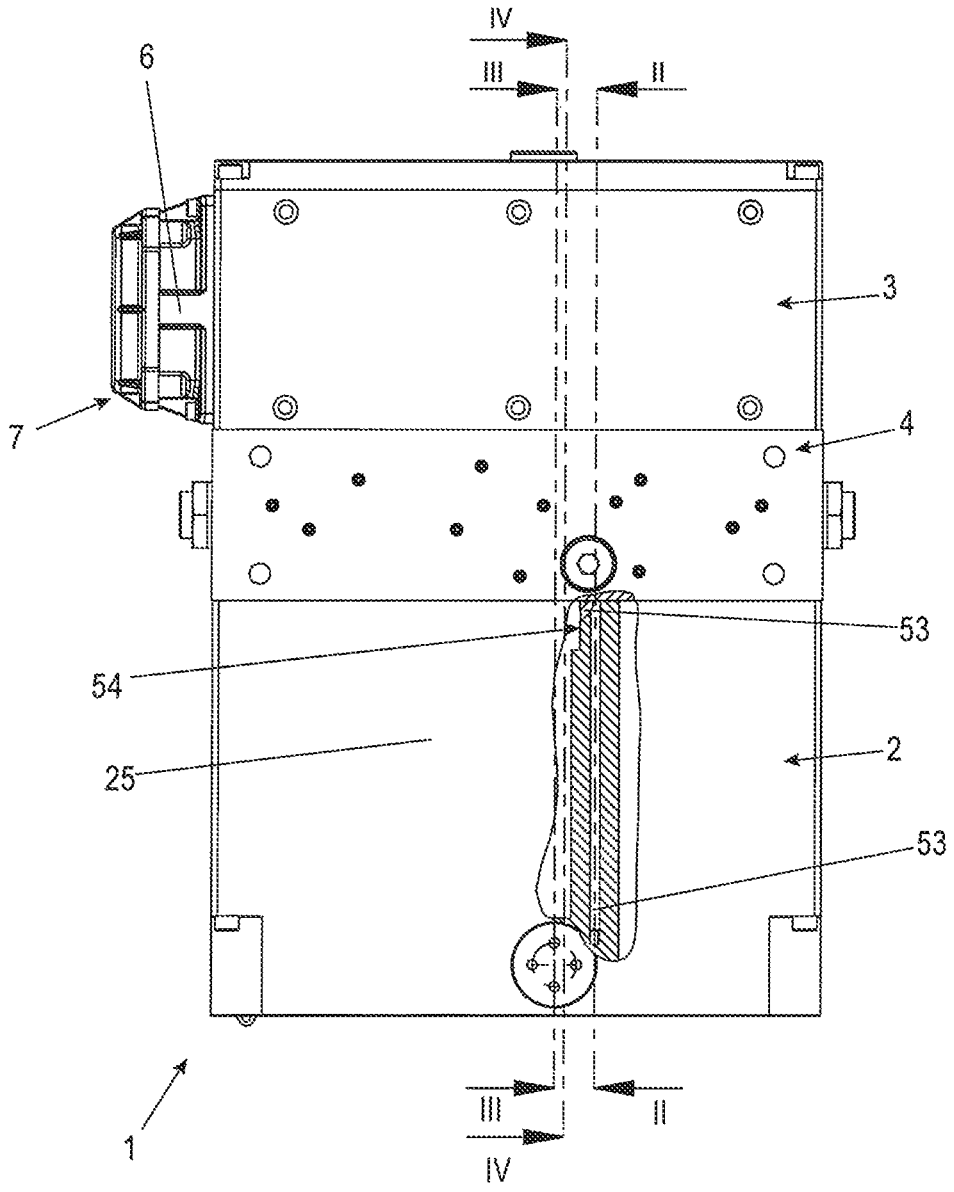
FIGS. 1-4 illustrate various diagrammatic sectional depictions through an embodiment variant of a hydraulic device according to the disclosed embodiments, showing channels of the channel labyrinth in the fluid container.
Figure 2:
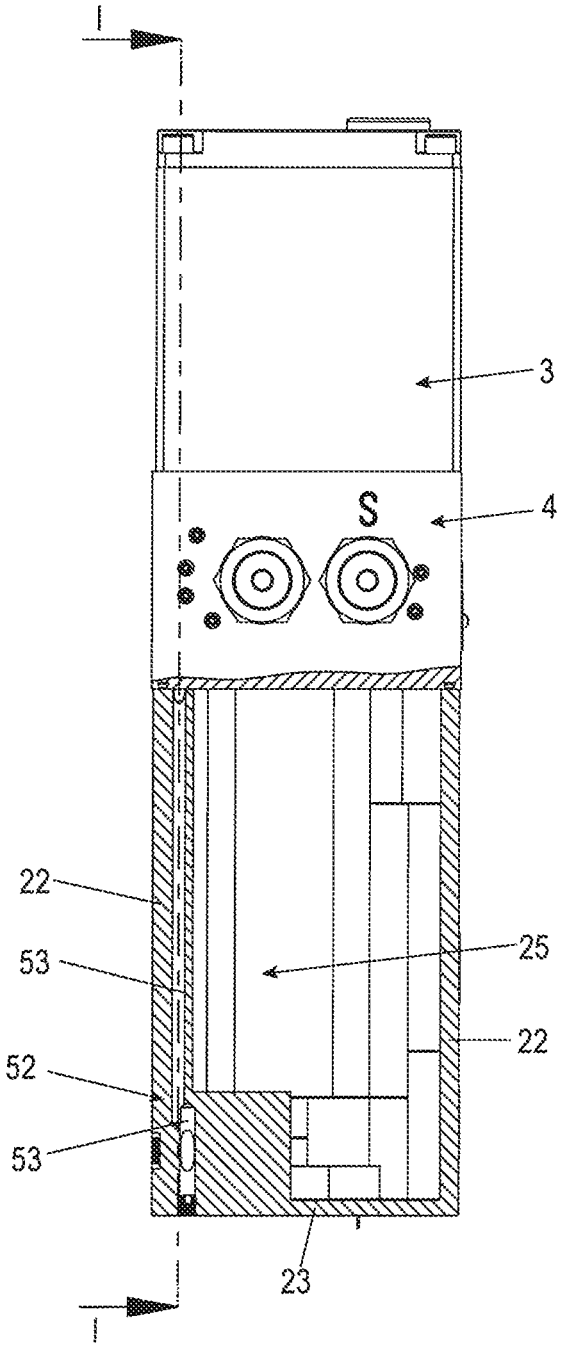

Conventional arrangement of the ventilation and purging unit explained above suffer from a problem that, when the ventilation and purging unit is integrated in the control plate, the arrangement takes up installation space for the necessary components within the control plate.

In addition, different installation positions of the hydraulic unit impose the necessity for differently designed variants of control plates. For example, a channel labyrinth integrated in the control plate, via which an air stream can be conveyed to the outside from the fluid container and in the opposite direction for ventilation and purging of the fluid container, requires further additional space in the control plate. Also, an airtight transfer point for the air stream between the fluid container and the control plate is necessary.

Further, the arrangement of the ventilation and purging unit outside the fluid container, at a highest point of the fluid container in the installed state, leads to extremely large dimensions of the fluid container.

To the contrary, disclosed embodiments provide a hydraulic device which is compact in construction and guarantees reliable ventilation and purging. The hydraulic devices for a rail vehicle may include a fluid container, a motor with a pump, a control plate, a control region, and a ventilation and purging unit for ventilating and purging the fluid container.

In accordance with disclosed embodiments, the ventilation and purging unit may have a valve unit integrated into a wall of a housing of the fluid container, and a channel labyrinth arranged in the fluid container and connected to the valve unit.

Because the channel labyrinth and valve unit may be arranged in the fluid container, the ventilation and purging unit does not take up any space in the control plate.

In addition, the fluid container may be constructed compactly since the encapsulation of the valve unit in the fluid container can be designed more compactly than a ventilation and purging unit connected to the fluid container outside the fluid container.

Disclosed embodiments enable provision of a hydraulic device that allows a complete and compact integration, independently of installation position, of a valve unit in the fluid container.

In addition, no interfaces to the control plate are required for connecting a ventilation and purging unit to the fluid container.

In addition, it is possible to provide a single control plate design, since no variants are necessary depending on installation position of the hydraulic device, whereby manufacturing costs may be reduced and delivery times shortened.

Finally, a more compact design of the fluid container and hence of the entire hydraulic device is possible, while retaining or extending the functionality.

Disclosed embodiments may provide a hydraulic device, wherein the channel labyrinth is mounted in an interior of the housing of the fluid container which is surrounded by the housing. This allows simple exchange of such a channel labyrinth so that, depending on installation position of the hydraulic device, a suitable channel labyrinth can be inserted in the fluid container.

According to an alternative embodiment, the channel labyrinth may be integrated in at least one wall of a housing of the fluid container. This also allows an extremely compact accommodation of the channel labyrinth, and in addition a stationary mounting of the valve unit in the housing of the fluid container.

According to at least one embodiment, at least one channel of the channel labyrinth opens into an interior of the fluid container surrounded by the housing, in the topmost region of the housing in the installation position of the fluid container. Thus in a simple fashion, purging of the fluid container via the connection of the channel labyrinth to the valve unit is possible.

According to at least one further embodiment, at least one channel of the channel labyrinth may open into an opening in a housing floor of the housing which is open towards an exterior of the fluid container surrounding the housing. This opening in the housing floor of the housing, and the labyrinth channel connected thereto and opening into the valve unit, may allow ventilation of the fluid container in a simple fashion.

According to at least one further embodiment, at least one of the channels of the channel labyrinth may be let into a wall reinforcement of a housing wall of the housing.

According to at least one embodiment of the invention, the valve unit may include at least one check valve. Alternatively, or in addition, the valve unit may include at least one diaphragm valve, in particular with a semi-permeable diaphragm. The use of a sintered filter is also possible.

With this understanding in mind, in the following description of the disclosed embodiments, terms such as top, bottom, left, right, front, rear etc. refer solely to the exemplary depictions and positions selected in the respective figures for the hydraulic device, fluid container, control plate, control region, ventilation and purging unit, channel labyrinth and similar. These terms should not be understood restrictively, i.e. these references may change due to different working positions or a mirror-symmetrical design or similar.

In FIGS. 1-4, an embodiment variant of a hydraulic device according to the invention for a rail vehicle is designated as a whole with reference sign 1.

The hydraulic device 1 substantially includes a fluid container 2, a control plate 4 arranged on an outer face of the fluid container 2, and a control region 3 arranged on the side of the control plate 4 facing away from the fluid container 2. A plug housing 6 is arranged on the control region 3 and is covered towards the outside by a protective cap 7.

The hydraulic device 1 may further include a motor (not shown here) with a pump which serves to pump the hydraulic fluid stored in the fluid container 2, for example a hydraulic oil, into the control plate 4.

Figure 5:
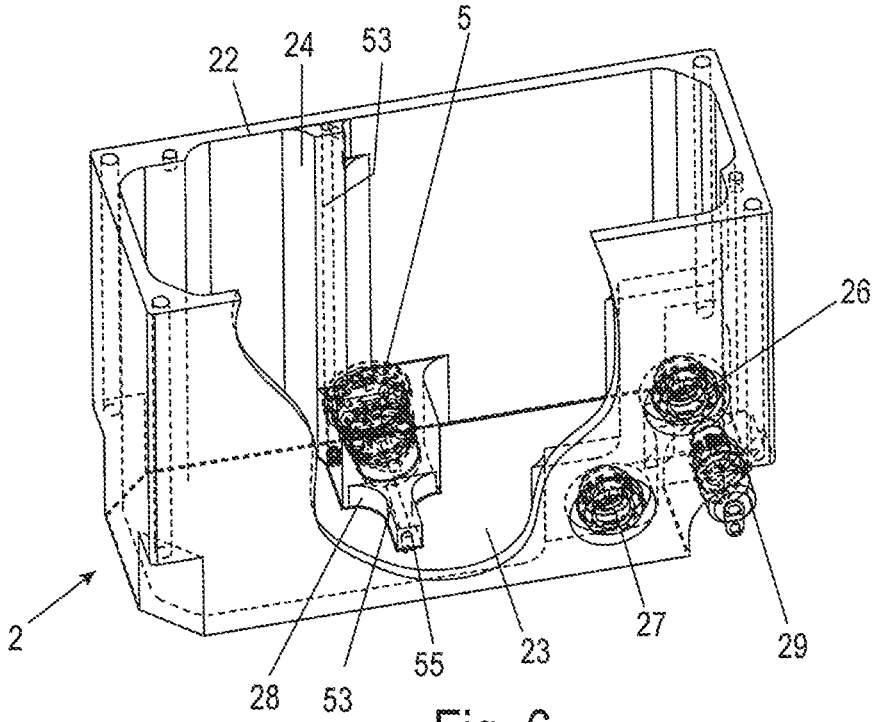
FIGS. 5 and 6 provide different perspective depictions of a partly opened fluid container with valve unit installed therein and channel labyrinth, and FIG. 7 provides a perspective depiction of the fluid container shown in FIGS. 5 and 6 with covered channel labyrinth and valve unit.
Figure 6:
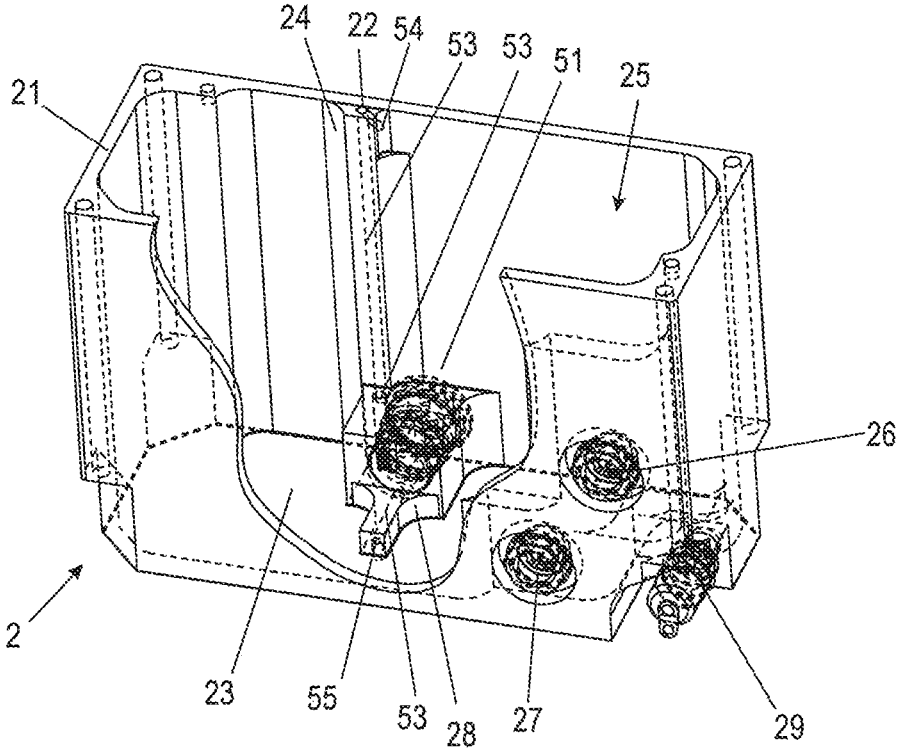
Figure 7:
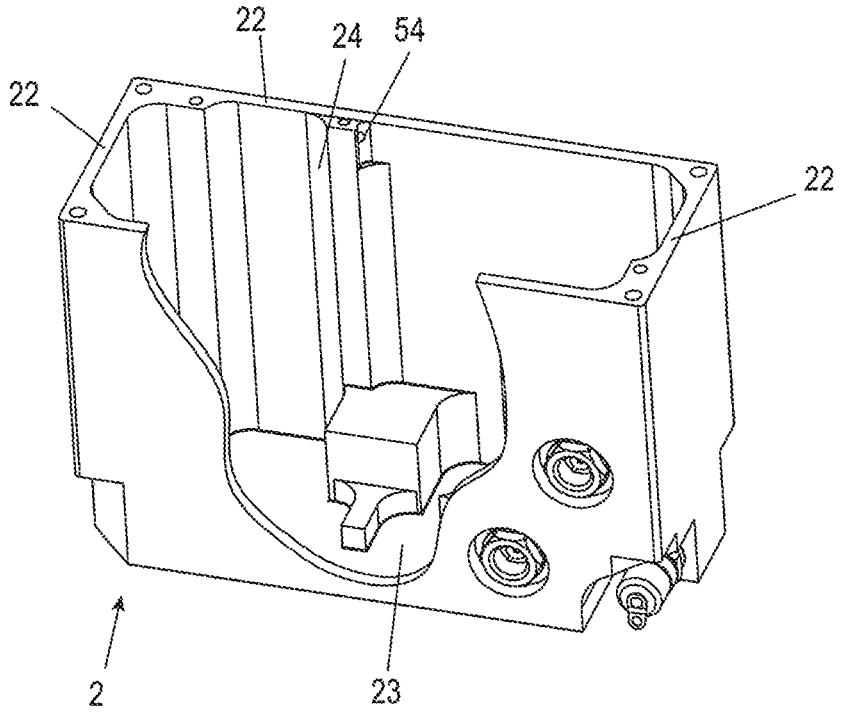

The fluid container 2 may further include—as shown in FIGS. 5-7—a fluid inlet 29 and optionally two sight glasses 26 and 27 for checking the fluid present in the fluid container.

As shown in FIGS. 1-4 which illustrate different sectional depictions through the hydraulic device 1, and in the perspective open depictions of the fluid container 2 shown in FIGS. 5-7, the hydraulic device 1 may further include a ventilation and purging unit 5 for ventilation and purging of the fluid container 2.

This ventilation and purging unit 5 has a valve unit 51 integrated in a wall 22 of a housing 21 of the fluid container 2, and a channel labyrinth 52 connected to the valve unit 51.

In the depictions shown here, the channel labyrinth 52 is integrated in at least one wall 22 of the housing 21 of the fluid container 2.

Thus for example FIGS. 5 and 6 show such a channel 53 in a rear wall 22 of the housing 21 of the fluid container 2. As FIG. 6 clearly shows, this channel 53 extends from a valve unit 51, integrated into the rear wall 22 close to the floor 23 of the fluid container 2, along the wall 22 of the housing 21 up to an upper front edge of the housing 21.

From there, a further channel 53 leads to an opening 54 which is open towards an interior 25 of the housing 21 of the fluid container 2.

Via these labyrinth channels 53 which open into the valve unit 51, on corresponding switching of the valve unit 51, the interior 25 of the fluid container 2 can be purged.

As furthermore shown in FIG. 6, a further part of the channel labyrinth 52 is arranged in a wall reinforcement 28 in the region of the floor 23 of the housing 21 of the fluid container 2, and opens into an opening 55 in the housing floor 23 of the housing 21.

It is also conceivable to provide, instead of the opening in the floor 23 of the housing 21, an opening in a region of one of the housing walls 22 close to the floor 23 of the housing 21.

This part of the channel labyrinth 52, which also opens into the valve unit 51, allows ventilation of the fluid container 2 on corresponding switching of the valve unit 51.

In an alternative embodiment (not shown here), separate channel labyrinths are provided for ventilation and purging of the fluid container 2. Accordingly, in this embodiment, the ventilation and purging unit 5 has a first channel labyrinth for ventilation and a second channel labyrinth for purging.

The arrangement of the channels 53 in the housing walls 22 shown here, or in a wall reinforcement 24 of a housing wall 22 as shown in FIGS. 5 and 6, should be understood as exemplary. Depending on the proposed installation position of the fluid container or hydraulic device 1, the channels 53 are arranged in different regions of the housing walls 22 or housing floor 23.

Figure 4:
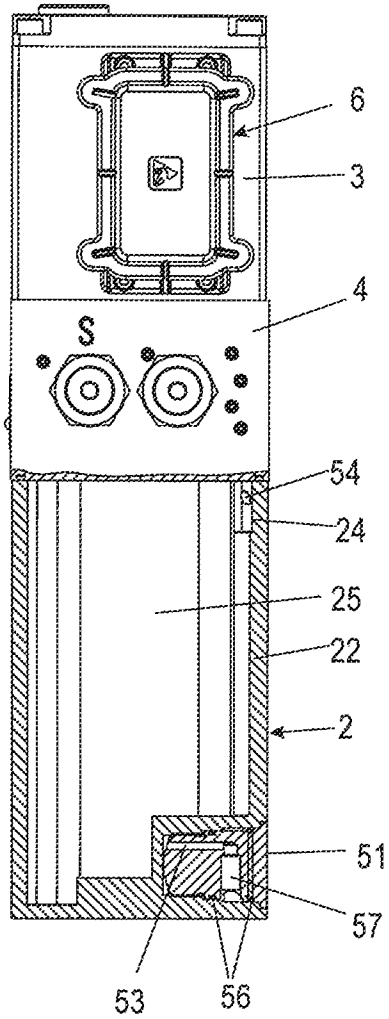
Figure 3:
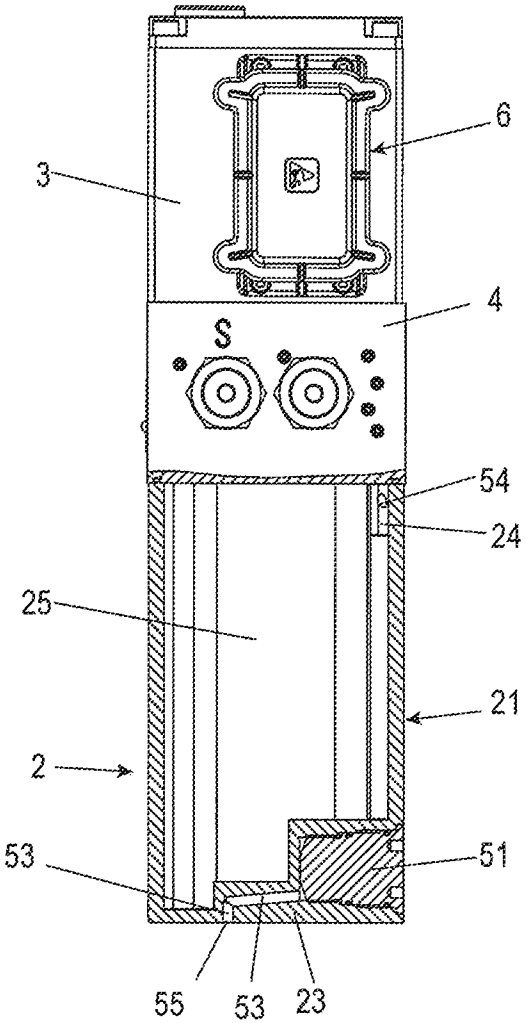

The valve unit 51 optionally has at least one check valve 57 as shown for example in FIG. 4.

Optionally, the valve unit 51 has two check valves with mutually opposite flow directions.

The check valves here are optionally spring-loaded, tightly sealing valves with elastomer or metallic sealing geometry, such as for example a ball or cone seat. The elastomer used for example is an elastomer membrane.

It is also conceivable that the valve unit 51 is designed as a diaphragm valve, in particular with a semi-permeable diaphragm. The use of sintered filters is also conceivable.

When the valve unit 51 is used as a diaphragm filter, the air pressure in the interior 25 of the fluid container 2 is set to ambient air pressure.

In this way, air can flow in both directions through the valve unit 51 formed as a diaphragm or sintered filter, but not the larger molecules of the fluid stored in the fluid container 2, in particular oil molecules.

It is also conceivable to insert a screen for pre-cleaning the aspirated air in the region of the valve unit 51.

According to an alternative embodiment (not shown here), it is also conceivable to install the channel labyrinth 52 in an interior 25 of the housing 21 of the fluid container 2 which is surrounded by the housing 21. This installation allows simple exchange of such a channel labyrinth 52.

It is also conceivable to design the fluid container 2 in several parts, with a universal container with a first housing which is adapted to a required minimum fluid and air volume and can be supplemented as required by one or more housing constructions.

The channels 53 of the channel labyrinth 52 may be configured, as described above, as cavities in the housing 21 or also as pipes.

LIST OF REFERENCE SIGNS

1 Hydraulic device
2 Fluid container
21 Housing
22 Housing wall
23 Housing floor
24 Wall reinforcement
25 Interior
26 Sight glass
27 Sight glass
28 Wall reinforcement
29 Fluid inlet
3 Control region
4 Control plate
5 Ventilation and purging unit
51 Valve unit
52 Channel labyrinth
53 Channel
54 Purge opening
55 Ventilation opening
56 Seal
57 Check valve
6 Plug housing
7 Protective cap

The invention claimed is:

1. A hydraulic device for a rail vehicle, the hydraulic device comprising:

a fluid container;

a motor with a pump;

a control plate;

a control region; and a ventilation and purging unit for ventilating and purging the fluid container, wherein the ventilation and purging unit has a valve unit integrated into a wall of a housing of the fluid container, and a channel labyrinth arranged in the fluid container and connected to the valve unit, wherein the channel labyrinth of the ventilation and purging unit has a first channel labyrinth for ventilation and a second channel labyrinth for purging, wherein the channel labyrinth is integrated in at least one wall of a housing of the fluid container.

2. The hydraulic device of claim 1, wherein the channel labyrinth is mounted in an interior of the housing of the fluid container, which is surrounded by the housing.

3. The hydraulic device claim 1, wherein at least one channel of the channel labyrinth opens into an interior of the fluid container surrounded by the housing in the topmost region of the housing in the installation position of the fluid container.

4. The hydraulic device of claim 1, wherein at least one channel of the channel labyrinth opens into an opening in a housing floor of the housing which is open towards an exterior of the fluid container surrounding the housing.

5. The hydraulic device of claim 1, wherein at least one channel of the channel labyrinth opens into an opening in a region of a housing wall close to the housing floor of the housing which is open towards an exterior of the fluid container surrounding the housing.

6. The hydraulic device of claim 1, wherein at least one of the channels of the channel labyrinth is let into a wall reinforcement of a housing wall.

7. The hydraulic device of claim 1, wherein the valve unit includes at least one check valve.

8. The hydraulic device of claim 1, wherein the valve unit includes at least one diaphragm valve.

* * * * *